US011545349B2

(12) United States Patent
Kim et al.

(10) Patent No.: US 11,545,349 B2
(45) Date of Patent: Jan. 3, 2023

(54) MATRIX-ASSISTED LASER DESORPTION/IONIZATION MASS SPECTROMETRY METHOD

(71) Applicant: BIONEER CORPORATION, Daejeon (KR)

(72) Inventors: Taeman Kim, Daejeon (KR); Do Hoon Kim, Daejeon (KR); Jong Rok Ahn, Daejeon (KR); Han-Oh Park, Daejeon (KR)

(73) Assignee: BIONEER CORPORATION, Daejeon (KR)

( * ) Notice: Subject to any disclaimer, the term of this patent is extended or adjusted under 35 U.S.C. 154(b) by 0 days.

(21) Appl. No.: 16/347,040

(22) PCT Filed: Oct. 30, 2017

(86) PCT No.: PCT/KR2017/012053
§ 371 (c)(1),
(2) Date: May 2, 2019

(87) PCT Pub. No.: WO2018/084511
PCT Pub. Date: May 11, 2018

(65) Prior Publication Data

US 2019/0279853 A1 Sep. 12, 2019

(30) Foreign Application Priority Data

Nov. 3, 2016 (KR) ..... 10-2016-0145936

(51) Int. Cl.
*H01J 49/16* (2006.01)
*H01J 49/04* (2006.01)
(Continued)

(52) U.S. Cl.
CPC ..... *H01J 49/0418* (2013.01); *H01J 49/10* (2013.01); *H01J 49/16* (2013.01); *H01J 49/40* (2013.01)

(58) Field of Classification Search
CPC .. G01N 27/62; H01J 49/0027; H01J 49/0036; H01J 49/0418; H01J 49/10; H01J 49/16; H01J 49/164; H01J 49/40
See application file for complete search history.

(56) References Cited

U.S. PATENT DOCUMENTS 9,404,918 B2 * 8/2016 D'Aloia ..... G01N 33/50
2005/0261838 A1 * 11/2005 Andreev ..... H01J 49/004 702/22

(Continued)

FOREIGN PATENT DOCUMENTS

CN 106133149 A 11/2016
JP 2006523845 A 10/2006

(Continued)

OTHER PUBLICATIONS

European Patent Office, Extended European Search Report Issued in Application No. 17867075.8, dated May 7, 2020, Germany, 8 pages.

(Continued)

*Primary Examiner* — Wyatt A Stoffa
(74) *Attorney, Agent, or Firm* — McCoy Russell LLP

(57) ABSTRACT

The present invention relates to a matrix-assisted laser desorption ionization mass spectrometry method and, specifically, a mass spectrometry method according to the present invention comprises the steps of: acquiring a mass spectrum of an analyte by performing matrix-assisted laser desorption ionization of the analyte, wherein a detection spectrum, which is the mass spectrum of the analyte, is acquired using each of two or more matrixes different from one another; and removing, from each detection spectrum, a peak of a corresponding matrix to obtain a matrix-removed (Continued)

spectrum, and then acquiring a corrected mass spectrum of the analyte on the basis of a matrix-removed spectrum for each of different matrixes.

11 Claims, 5 Drawing Sheets

(51) Int. Cl.
*H01J 49/40* (2006.01)
*H01J 49/10* (2006.01)

(56) References Cited

U.S. PATENT DOCUMENTS

2005/0269507 A1 12/2005 Davidson et al.
2007/0038387 A1* 2/2007 Chen ..... H01J 49/0036 702/23
2012/0303288 A1* 11/2012 Morinaga ..... G16B 40/00 702/23
2015/0186754 A1* 7/2015 Paauw ..... H01J 49/0036 382/224
2016/0225595 A1* 8/2016 Hizume ..... H01J 49/0036
2016/0237469 A1* 8/2016 Stubiger ..... G01N 33/6851
2016/0240362 A1* 8/2016 Panchagnula ..... H01J 49/164
2019/0154643 A1* 5/2019 Yamada ..... G01N 30/8682
2022/0311990 A1* 9/2022 Makinen ..... H04N 13/322

FOREIGN PATENT DOCUMENTS

JP 4918662 B2 2/2012
JP 2013238407 A 11/2013
JP 2015121500 A 7/2015
WO 2013008723 A1 1/2013
WO 2014014353 A1 1/2014

OTHER PUBLICATIONS

ISA Korean Intellectual Property Office, International Search Report Issued in Application No. PCT/KR2017/012053, dated Feb. 2, 2018, WIPO, 4 pages.

* cited by examiner

MATRIX-ASSISTED LASER DESORPTION/IONIZATION MASS SPECTROMETRY METHOD

CROSS-REFERENCE TO RELATED APPLICATIONS

The present application is a U.S. National Phase of International Patent Application Serial No. PCT/KR2017/012053 entitled "MATRIX-ASSISTED LASER DESORPTION/IONIZATION MASS SPECTROMETRY METHOD," filed on Oct. 30, 2017. International Patent Application Serial No. PCT/KR2017/012053 claims priority to Korean Patent Application No. 10-2016-0145936, filed on Nov. 3, 2016. The entire contents of each of the above-cited applications are hereby incorporated by reference for all purposes.

TECHNICAL FIELD

The present invention relates to a matrix-assisted laser desorption/ionization mass spectrometry method.

BACKGROUND ART

Matrix-assisted laser desorption/ionization (MALDI) is known as an ionization method used in mass spectrometry. The MALDI method ionizes an analyte sample without decomposing molecules of the analyte by irradiating the sample with laser light for a short time and instantaneously vaporizing the sample.

In the MALDI mass spectrometry, a sample is prepared by mixing an analyte solution with a matrix solution, applying the mixture on a sample plate, and removing a solvent by vaporization. When the sample is irradiated with laser light, a matrix absorbs energy of the laser light and part of the matrix is rapidly heated and vaporized (desorbed) together with the analyte so as to be ionized. Thereafter, movement of charged ions in an electromagnetic field is measured to measure a molecular weight of the analyte.

With the MALDI mass spectrometry method, a molecular weight can be accurately measured because the analyte is not fragmented, the analyte at the level of a few femto moles may be detected due to good detection sensitivity, a mass spectrum is simple and easily analyzed due to a single charge, rather than multiple charges, a sample is simply prepared because the analyte and a matrix are mixed, dispensed to a sample plate, and dried to be analyzed, an analysis time is substantially short so as to be within one minute, enabling rapid analysis (high speed mass analysis), the sample is less affected by a contamination such as a buffer solution or salt, and cost for using and maintaining a device is low.

The MALDI mass spectrometry has been used particularly for ionizing high molecular weight compounds, but due to the above-described advantages, recently, demand for utilizing the MALDI mass spectrometry for low molecular weight compounds has been increased. However, in general, a substance used as a matrix in the MALDI mass spectrometry has a molecular weight of about a few hundred daltons (Da). Thus, when the MALDI mass spectrometry is performed using a matrices, ion peaks attributable to the matrix are remarkably observed in a low mass (m/z) region in a mass spectrum. In a case where the analyte is a high molecular weight compound, the presence of the matrix peaks at the low mass region is not problematic, but in a case where a molecular weight of an analyte is reduced, peaks originating from a low molecular compound aimed on the mass spectrum and peaks attributable to the matrix coexist to be very close to each other or may overlap each other, causing limitations in analyzing the analyte having a low molecular weight.

In order to overcome such limitations, research was conducted to replace an organic matrix with an inorganic matrix as in Japanese Patent Registration No. 4918662 and research was conducted to develop a new matrix as in International Patent No. WO2013/008723. However, in the case of the inorganic matrix, the ionization ratio is significantly lower than that of the organic matrix, and although a new matrix is developed, disturbance peaks attributable to the matrix may still exist, causing technical limitations in accurately and sensitively analyzing various low molecular compounds.

DISCLOSURE

Technical Problem

An object of the present invention is to provide a matrix-assisted laser desorption ionization mass spectrometry method capable of precisely detecting a low molecular weight compound.

Another object of the present invention is to provide a matrix-assisted laser desorption ionization mass spectrometry method capable of precisely detecting an extremely wide variety of compounds irrespective of the kinds of low molecular weight compounds.

Another object of the present invention is to provide a matrix-assisted laser desorption ionization mass spectrometry method which is free from matrix noise to obtain a complete mass spectrum of a compound.

Technical Solution

In one general aspect, a matrix-assisted laser desorption ionization mass spectrometry method includes: performing matrix-assisted laser desorption ionization on an analyte to obtain mass spectrums, wherein detection spectrums which are mass spectrums of the analyte and each of which is obtained using each of two or more different matrices; and removing peaks of the corresponding matrix from each detection spectrum to obtain a matrix-removed spectrum and subsequently obtaining a corrected mass spectrum of the analyte on the basis of the matrix-removed spectrum of each of the different matrices.

In the mass spectrometry method according to the present invention, since the matrix-removed spectrums are obtained by removing the peaks of the corresponding matrix and a corrected mass spectrum of the analyte is obtained on the basis of the matrix-removed spectrums of the different matrices, the problem by that precision is degraded due to a matrix peak in a mass analysis spectrum of a low molecular weight compound using each detection spectrum including a peak appearing in the same mass range using matrices of the same mass range may be fundamentally prevented.

In the mass spectrometry method according to an exemplary embodiment of the present invention, the corrected mass spectrum may be calculated by merging peaks commonly present in the two or more matrix-removed spectrums and peaks present only in one matrix-removed spectrum.

The mass spectrometry method according to an exemplary embodiment of the present invention may include: step a) of irradiating a first sample including the analyte and a first matrix with a laser to obtain a first detection spectrum and irradiating a second sample including the analyte and a second matrix with a laser to obtain a second detection spectrum; step b) of removing peaks of the first matrix from the first detection spectrum to obtain a first matrix-removed spectrum and removing peaks of the second matrix from the second detection spectrum to obtain a second matrix-removed spectrum; and step c) of obtaining a corrected mass spectrum of the analyte on the basis of the first matrix-removed spectrum and the second matrix-removed spectrum.

In the mass spectrometry method according to an exemplary embodiment of the present invention, step c) may include: merging a common peaks as a peaks commonly present in the first matrix-removed spectrum and the second matrix-removed spectrum and a complementary peaks as a peaks present only in one of the first matrix-removed spectrum and the second matrix-removed spectrum.

The mass spectrometry method according to an exemplary embodiment of the present invention may further include: correcting an intensities of the complementary peak using the intensity ratio between the common peak of the first matrix-removed spectrum and the common peak of the second matrix-removed spectrum, in the merging.

The mass spectrometry method according to an exemplary embodiment of the present invention may further include: in the merging, a step calculating an average intensity for each m/z of the common peak to obtain a common peak spectrum; and a step correcting the intensity of the complementary peak by multiplying a ratio, which is obtained by dividing an intensity of one peak on the common peak spectrum by the intensity of a peak in the same m/z as the one peak on the matrix-removed spectrum to which the merged complementary peak belongs, by an intensity of the complementary peak.

In the mass spectrometry method according to an exemplary embodiment of the present invention, step b) may further include: standardizing each of the first detection spectrum and the second detection spectrum, before the removal of the matrix peak, wherein the standardization step may be performed by dividing an intensity of each peak present in each detection spectrum by a total intensity obtained by accumulating the intensity of each peak present in each detection spectrum.

The mass spectrometry method according to an exemplary embodiment of the present invention may further include: a step, before the step a), irradiating each of a first reference sample not containing the analyte and containing the first matrix and a second reference sample not containing the analyte and containing the second matrix with a laser and obtaining a mass spectrum originating from each matrix.

In the mass spectrometry method according to an exemplary embodiment of the present invention, a m/z difference between most adjacent peaks of two matrices in the peaks of the first matrix and the peaks of the second matrix may be 1 or greater.

In the mass spectrometry method according to an exemplary embodiment of the present invention, the different matrices may be two or more substances selected from among α-cyano-4-hydroxycinnamic acid (CHCA), 2,5-dihydroxybenzoic acid (DHB), 2-(4-hydroxyphenylazo)-benzoic acid (HABA), 2-mercaptobenzo-thiazole (MBT), and 3-Hydroxypicolinic acid (3-HPA).

In the mass spectrometry method according to an exemplary embodiment of the present invention, the analyte may include a compound of 1000 daltons or less.

The mass spectrometry method according to an exemplary embodiment of the present invention may use a time-of-flight (TOF) mass spectrometer (MS), an ion trap (IT) MS, a Fourier transform ion cyclotron resonance (FT-ICR) MS, a quadrupole MS, or an orbitrap MS.

Advantageous Effects

According to the mass spectrometry method of the present invention, since a complete mass spectrum of the analyte is obtained by complementing mass spectrums obtained using different matrices, an analyte containing a low molecular weight compound may be accurately analyzed, a complete mass spectrum of the analyte may be obtained irrespective of the kind of the analyte, and extremely various kinds of substances may be precisely analyzed. In addition, according to the mass spectrometry method of the present invention, since the related art matrix effectively used as organic matrices in the MALDI mass spectrometry could be used without a restriction, it is unnecessary to develop a separate analysis platform, an excellent desorption/ionization rate is obtained, cost for analysis is low, an extremely simple sample preparation method is used, and excellent sensitivity is obtained.

BEST MODE

Figure 1:
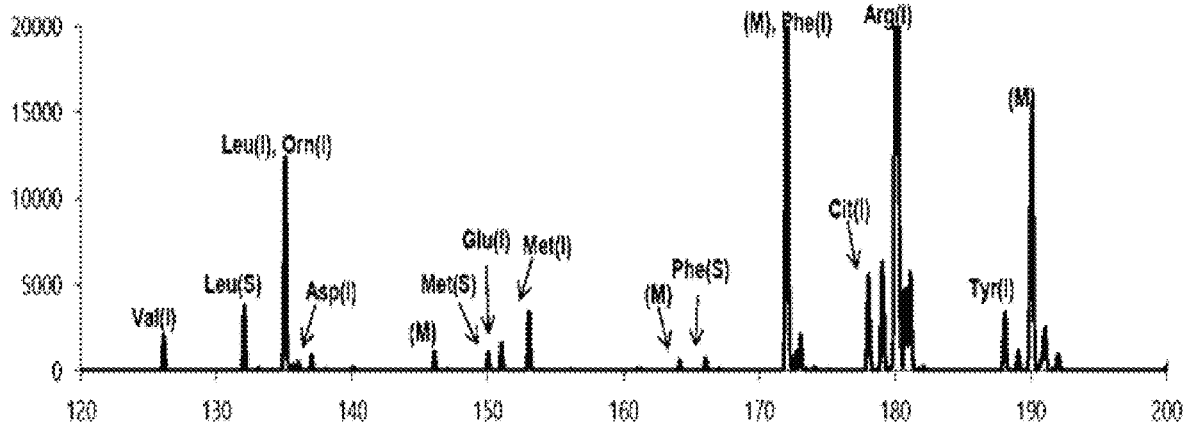
FIG. 1 is a view illustrating a first detection spectrum measured in an exemplary embodiment of the present invention.

Hereinafter, a mass spectrometry method of the present invention will be described in detail with reference to the accompanying drawings. Here, technical terms and scientific terms have the same meaning as generally understood by a person skilled in the art to which the present invention pertains, unless otherwise defined, and a detailed description for a related known function or configuration considered to unnecessarily divert the gist of the present invention will be omitted in the following descriptions and accompanying drawings.

In the matrix-assisted laser desorption/ionization (MALDI) mass spectrometry method, peaks originating from a matrix (organic matrix) are mainly present in a low molecular weight region of m/z 100 to 400 in a mass spectrum. Thus, in the case of analyzing a low molecular weight substance having a molecular weight of 1000 daltons or less, in particular, 500 daltons or less, the peaks originating from the matrix and peaks originating from an analyte coexist and the peaks even overlap to make it extremely difficult to analyze the intended analyte substantially. The method of using an inorganic matrix instead of an organic matrix acts as an obstacle to commercialization due to high analysis cost and an analysis technique for various types of analytes is yet to be established.

Thus, the applicant of the present invention intends to provide an analysis method capable of obtaining a complete mass spectrum of an analyte including a low molecular compound having a molecular weight of 1000 daltons or less, more characteristically, having a molecular weight of 500 daltons or less using an organic matrix generally used in the MALDI mass spectrometry.

The analysis method according to the present invention is a mass spectrometry method for an analyte using a matrix-assisted laser desorption ionization (MALDI) method and is a mass spectrometry method for an analyte containing a compound having a molecular weight of 1000 daltons or less, specifically, 500 daltons or less. The analysis method according to the present invention includes: performing matrix-assisted laser desorption ionization on an analyte to obtain a mass spectrum, wherein a detection spectrum which is a mass spectrum of the analyte is obtained using each of two or more different matrices; and removing a peak of a corresponding matrix from each detection spectrum to obtain a matrix-removed spectrum and subsequently obtaining a corrected mass spectrum of the analyte on the basis of the matrix-removed spectrum of each of the different matrices.

As described above, the analysis method according to the present invention obtains a complete mass spectrum (corrected mass spectrum) of the analyte by mutually complementing mass spectrums obtained using the different matrices, rather than by suppressing desorption/ionization of a matrix itself as much as possible or enhancing accuracy and sensitivity with specializing an analysis method during analyzing.

The analysis method according to the present invention may fundamentally prevent the problem of degraded precision due to a matrix peak in a mass analysis spectrum of a low molecular weight compound by using each detection spectrum including peaks appearing in the same mass range using matrices of the same mass range. Specifically, according to the analysis method of the present invention, matrix-removed spectrums are obtained by removing corresponding matrix peaks from the respective detection spectrums and spectrum information lost due to the removal of the matrix peaks is complemented using the matrices of the same mass range at the time of obtaining the respective detection spectrums to obtain a corrected mass spectrum, thus solving the problem that precise mass spectrometry of a low molecular compound is difficult as the peaks in the mass spectrum of a low molecular compound when analyzing the low molecular compound and the peak of the matrix itself overlap.

Thus, while the analyte having a low molecular weight is accurately analyzed and a complete mass spectrum of the analyte is obtained regardless of the kind of the analyte, the matrix, which is generally used as an organic matrix in the MALDI mass spectrometry and is advantageously and effectively used, is used without a restriction, and thus, the advantages of the related art MALDI method using the organic matrix may be used as is. Specifically, advantages of the related art MALDI method using an organic matrix, such as excellent desorption/ionization rate, low cost of analysis, extremely simple sample preparation, analytical ability of various substances, and the like, may be maintained as is.

As described above, in the present invention, any organic matrix used in the related art MALDI mass spectrometry may be used, and here, when a detection spectrum is obtained, a mass spectrum of the analyte may be obtained for each matrix using two or more organic matrices, specifically, two to five organic matrices, and more specifically, two to three organic matrices.

When the detection spectrum is obtained, as the number of used matrices increases, the mass spectrum of the analyte itself having higher reliability can be obtained. However, as the number of matrix used increases, the cost and time required for analyzing the material increase, and it is most advantageous to perform analysis using two possible matrices.

To this end, advantageously two or more types of matrices in which peaks originating from the matrices themselves in mass spectrums are different from each other (do not overlap each other) are used to obtain detection spectrums. In the case of using the matrices in which peaks do not overlap, a complete mass spectrum of the analyte may be obtained even with only two types of matrices. Also, the matrices may advantageously be two or more types of matrices in which a difference in mass (m/z) between the most adjacent peaks, among the peaks originating from the matrices (matrices themselves), is 1 or greater, and preferably, 5 or greater. When the matrices have different peaks and a smallest difference in mass (m/z) between a peak of one matrix and a peak of the other matrix is 1 or greater, and preferably, 5 or greater, the peaks originating from the matrices and peaks originating from the analyte may be stably separately detected in resolution of the general MALDI mass spectrometry, and the complete mass spectrum of the analyte may be accurately, stably, and reliably calculated even with the two types of the matrices.

Any set of organic matrices may be effectively used in step a), provided that they are organic matrices having different mass spectrums and in which a mass difference between most adjacent peaks thereof is 1 or greater, and preferably, 5 or greater. In a specific example, the organic matrix used in step a) may be two or more substances selected from among α-cyano-4-hydroxycinnamic acid (CHCA), 2,5-dihydroxybenzoic acid (DHB), 2-(4-hydroxyphenylazo)-benzoic acid (HABA), 2-mercaptobenzo-thiazole (MBT), and 3-Hydroxypicolinic acid (3-HPA). In a more specific example, the organic matrix used in step a) may be two or more substances selected from among α-cyano-4-hydroxycinnamic acid (CHCA), 2,5-dihydroxybenzoic acid (DHB), 2-(4-hydroxyphenylazo)-benzoic acid (HABA), 2-mercaptobenzo-thiazole (MBT), and 3-Hydroxypicolinic acid (3-HPA). In a further more specific example, the set of organic matrices (one matrix/the other matrix) used in step a) may be α-cyano-4-hydroxycinnamic acid (CHCA)/2,5-dihydroxybenzoic acid (DHB), but the present invention is not limited by a specific type of the organic matrices used in step a).

After the detection spectrums are obtained, the peaks of the corresponding matrices are removed from the detection spectrums to obtain matrix-removed spectrums, and thereafter, a corrected mass spectrum of the analyte may be calculated on the basis of the different matrix-removed spectrums of the matrices.

The peak of the corresponding matrix refers to the peak of the matrix used in each detection spectrum, and the peak of the matrix refers to the peak of the matrix ion originating from the matrix in the mass spectrum. In addition, the matrix-removed spectrum is a spectrum in which a peak which is not spaced apart (separated) from a peak of the matrix ion originating from the matrix and present as a peak continued from the peak of the matrix ion (in the form of multi-peaks of a pair of peaks or more being connected to each other) was also removed.

As the peaks of the corresponding matrix is removed in each detection spectrum, the peaks of the ions originating from the analyte may be present in the matrix-removed spectrum, and in addition, only the peaks of the ions originating from the analyte may be present (here, background noise may be present). As the peak of the matrix was removed, each matrix-removed spectrum has incomplete peak information of the analyte. However, since two or more different matrix-removed spectrums are obtained by the two or more different matrices, the mass spectrum of a complete analyte may be calculated through the two or more matrix-removed spectrums. That is, since the other matrix-removed spectrum has the incomplete information present in one matrix-removed spectrum, a complete mass spectrum (corrected mass spectrum of the analyte) of the analyte having a molecular weight of 1000 daltons or less, characteristically, 500 daltons or less may be calculated through the matrix-removed spectrums of the different matrices, and the analyte having the molecular weight of 1000 daltons or less, characteristically 500 daltons or less may be detected and verified.

Specifically, the corrected mass spectrum of the analyte may be calculated by merging the peaks commonly present in the two or more matrix-removed spectrums and the peaks present only on one matrix-removed spectrum.

When merging, in the mass spectrum(s) respectively obtained using two or more different matrices, the peak(s) present only in the other mass spectrum with respect to one mass spectrum may be merged in one mass spectrum. Alternatively, in the mass spectrum(s) respectively obtained using the different matrices, the commonly present peak(s) are extracted and the peak(s) present only in each of the mass spectrums are extracted, and the extracted peak(s) are merged.

More specifically, the analysis method according to an exemplary embodiment of the present invention includes: a step a) irradiating a first sample including the analyte and a first matrix with a laser to obtain a first detection spectrum and irradiating a second sample including the analyte and a second matrix with a laser to obtain a second detection spectrum; a step b) removing a peak of the first matrix from the first detection spectrum to obtain a first matrix-removed spectrum and removing a peak of the second matrix from the second detection spectrum to obtain a second matrix-removed spectrum; and a step c) obtaining a corrected mass spectrum of the analyte on the basis of the first matrix-removed spectrum and the second matrix-removed spectrum.

That is, the step a) is a step of measuring mass spectrums for each matrix using at least two or more matrices (first matrix and second matrix) which are different from each other.

In the step a), the mass spectrum (first detection spectrum or second detection spectrum) of each matrix, which is a spectrum obtained as a laser is irradiated to the sample and ions desorbed and ionized are detected by a detector, may be a mass spectrum having intensity of detected ions as one axis and m/z (mass-to-change ratio) as another axis. Thus, the mass spectrum (first detection spectrum or the second detection spectrum) of each matrix obtained in step a) may be a spectrum in which the peaks attributable to each matrix and peaks attributable to the analyte coexist. Here, the mass spectrum (first detection spectrum or second detection spectrum) of each matrix may be a spectrum smoothed using an algorithm which is known and generally used such as a Savitsky-Golay algorithm.

The first sample and the second sample may be placed to be spaced apart from each other on a single sample plate for MALDI or may be placed on different sample plates for MALDI, respectively. In addition, the first sample and the second sample may be prepared through a method commonly used in MALDI mass spectrometry using organic matrices. In a specific example, the sample (first sample or second sample) may be prepared by applying a sample liquid containing a matrix and an analyte on a sample plate dropwise and subsequently volatilizing and removing a solvent. Alternatively, the sample may be prepared by applying a solution containing an analyte to an upper portion of a matrix of a sample plate on which the matrix has already been formed and subsequently volatilizing and removing a solvent. However, as described above, the first sample and the second sample may be any samples which are prepared by the commonly used sample preparation method of the MALDI mass spectrometry and are not limited to the specific examples described above.

In the mass spectrum (first detection spectrum or second detection spectrum) of each matrix in the step a), laser irradiation conditions including irradiation intensity of the laser, a wavelength of the irradiated laser, the number of irradiation times of the laser, a pulse type and the number of pulses in the case of a pulse type laser, an irradiation area of the laser, and the like, may be the same or may be different. This is because, as described hereinafter, a difference between mass spectrums caused due to the laser irradiation conditions, together with the difference between mass spectrums due to the uniqueness of substances of each matrix, may also be corrected through the step of correcting the mass spectrum (first detection spectrum or second detection spectrum) of each matrix at the time of merging in step c). Here, however, in order to enhance accuracy of the finally calculated mass spectrum (mass spectrum in step c)) and perform merging through simple correction, the laser irradiation conditions for irradiating the laser to each sample in the step a) may be advantageously the same. Here, the irradiated laser may be a laser having a wavelength band absorbed by each matrix, and may be a laser commonly used in the MALDI mass spectrometry. In a specific and non-limiting example, the irradiated laser may be an ultraviolet (UV) laser or an infrared (IR) laser. The UV laser may include a $N_2$ laser, an Nd/YAG laser, an eximer layer, and the like, and the IR layer may include a $CO_2$ layer, an Er/YAG layer, and the like.

After obtaining the mass spectrum of each matrix (first detection spectrum or second detection spectrum) by measurement in step a), peaks of the first matrix may be removed from the first detection spectrum to obtain a first matrix-removed spectrum and peaks of the second matrix may be removed from the second detection spectrum to obtain a second matrix-removed spectrum in the step b).

This means that the peaks corresponding to m/z of ions originating from each matrix itself are removed from the mass spectrum (first detection spectrum or second detection spectrum) of each matrix. That is, the step b) may be a step of removing a peak corresponding to m/z of the ions attributable to the first matrix, from the first detection spectrum to calculate the first matrix-removed spectrum and removing a peak corresponding to m/z of the ions attributable to the second matrix, from the second detection spectrum to calculate the second matrix-removed spectrum.

Here, in the present invention, since the well-known and commonly used organic matrix is used, the first matrix or the mass of ions attributable to the first matrix may be well known values. Accordingly, the m/z values at which peaks appear in the mass spectrum of each matrix according to types of each matrix in the step b) may be predetermined values.

Alternatively, the step b) may be performed by detecting m/z of the ions originating from each of the types of the matrices by measuring a mass spectrum of each matrix itself and removing peaks placed at the detected m/z corresponding to m/z values of the ions originating from each matrix, from the mass spectrum (first detection spectrum or second detection spectrum) of each matrix.

Specifically, before step a), irradiating each of a first reference sample not containing the analyte and containing the first matrix and a second reference sample not containing the analyte and containing the second matrix with a laser to obtain a mass spectrum originating from each matrix may be further performed. Specifically, the first reference sample may be the same sample as the first sample except that it does not contain the analyte, and the second reference sample may be the same sample as the second sample except that it does not contain the analyte. In addition, MALDI mass spectrometry measurement conditions (laser irradiation condition, etc.) for obtaining the mass spectrum originating from each matrix using the first reference sample may be similar to or the same as measurement conditions of the first sample, and MALDI mass spectrometry measurement conditions (laser irradiation condition, etc.) for obtaining the mass spectrum originating from each matrix using the second reference sample may be similar to or the same as measurement conditions of the second sample, but are not limited thereto.

Thus, in the step b), the peaks corresponding to the m/z values of the ions attributable to the corresponding matrix are removed from each detection spectrum of the step a) to obtain a matrix-removed spectrum in which a peak due to the matrix is not present. That is, the matrix-removed spectrum is a spectrum in which the peaks originating from the matrix used in the detection spectrum are not present, the peak of the analyte overlapping the peak of the matrix is also not present, and the partial (incomplete) peaks of analyte are present.

Specifically, the first matrix-removed spectrum is a spectrum from which the peaks originating from the first matrix were removed and the peak information of the analyte overlapping the peak of the first matrix was also removed, thus having information regarding a partial (incomplete) peaks of the analyte. Also, the second matrix-removed spectrum is a spectrum from which the peaks originating from the second matrix were removed and the peak information of the analyte overlapping the peak of the second matrix was also removed, thus having information regarding a partial (incomplete) peaks of the analyte. However, the peak (peak information) of the analyte removed from the first matrix-removed spectrum is present in the second matrix-removed spectrum, and the peak (peak information) of the analyte removed from the second matrix-removed spectrum is present in the first matrix-removed spectrum. Accordingly, through the step (c), a corrected mass spectrum, which is a complete mass spectrum of the analyte and a mass spectrum free from each matrix, may be obtained using the first matrix-removed spectrum and the second matrix-removed spectrum.

Specifically, the step c) may include: a step merging a common peak as a peak commonly present in the first matrix-removed spectrum and the second matrix-removed spectrum and a complementary peak as a peak present only in one of the first matrix-removed spectrum and the second matrix-removed spectrum.

That is, peak information (m/z and intensity) of peaks which are commonly present in all the matrix-removed spectrums is extracted, and peak information (m/z and intensity) of peaks which are present only in one of the matrix-removed spectrums is extracted, and the common peak which is commonly present and the complementary peak as a peak present only in one spectrum are then merged to thus calculate a complementary spectrum as a mass spectrum of the complete analyte.

As the matrices are different for each matrix-removed spectrum, laser desorption/ionization rates may be different even for the same analyte. Thus, in the merging, correcting the difference in intensity of the merged peaks caused due to a difference in matrices may be further performed, and thereafter, the corrected peaks may be combined.

Specifically, in the merging, correcting the intensity of the complementary peak using an intensity ratio between the common peak of the first matrix-removed spectrum and the common peak of the second matrix-removed spectrum may be performed, and after the correcting step may be performed, the common peak and the complementary peak may be combined with each other to obtain the complementary spectrum.

In an example, regarding one m/z value ($m_a/z$) of the common peak, the intensity of the complementary peak may be corrected using the intensity ratio between the intensity of one m/z value ($m_a/z$) in the first matrix-removed spectrum and the intensity of one m/z value ($m_a/z$) in the second matrix-removed spectrum.

That is, in case that the intensity ratio between the common peaks at one m/z value ($m_a/z$)=intensity at $m_a/z$ on the first matrix-removed spectrum/intensity at $m_a/z$ on the second matrix-removed spectrum (I2a), when the complementary peak is a peak which belongs to the first matrix-removed spectrum, m/z of the complementary peak is maintained, while the original intensity ($I_0$) of the complementary peak is multiplied by I2a/I1a so as to be corrected to a complemented intensity and combined with the second matrix-removed spectrum. In another example, in case that the intensity ratio between the common peaks at one m/z value ($m_a/z$)=intensity at $m_a/z$ on the first matrix-removed spectrum (I1a)/intensity at $m_a/z$ on the second matrix-removed spectrum (I2a), when the complementary peak is a peak which belongs to the second matrix-removed spectrum, m/z of the complementary peak is maintained, while the original intensity ($I_0$) of the complementary peak is multiplied by I1a/I2a so as to be corrected to a complemented intensity and combined with the first matrix-removed spectrum.

Here, although not particularly limited, in terms of increasing accuracy of correction, one m/z ($m_a/z$), which is a criterion of the intensity ratio, may be one mass of the common peak closest to the complementary peak in the matrix-removed spectrum. However, the present invention is not limited to the one m/z which is a criterion of the intensity ratio at the time of correction, and that the intensity of the complementary peak may be corrected using an average of the intensity ratios between the common peaks, which, also, obviously belongs to a modification of the present invention.

In the above-mentioned example, the complementary spectrum is obtained by merging the one of the matrix-removed spectrums and the complementary peak, but the present invention is not limited thereto.

In another example, the complementary spectrum may be obtained by separately selecting common peaks and complementary peaks from the matrix-removed spectrums and combining the common peaks and the complementary peaks by complementing intensities thereof, rather than being based on a certain one matrix-removed spectrum.

The intensity of the common peak may be complemented using a weight average method, and the intensity of the complementary peak may be complemented using an intensity ratio of the complemented intensity of the common peak and the common peak (corresponding common peak on the spectrum to which the complementary peak belongs) before the intensity is complemented. Specifically, the method may include calculating an average intensity for each m/z of the common peak to obtain a common peak spectrum; and correcting the intensity of the complementary peak by multiplying a ratio obtained by dividing the intensity of one peak on the common peak spectrum by the intensity at the same m/z as the one peak on the matrix-removed spectrum to which the merged complementary peak belongs. That is, after the common peak (m/z and intensity) commonly present in the matrix-removed spectrum(s) is selected, an average strength ($I_{ave}$) of the matrix-removed spectrum at the corresponding m/z of each m/z value of the common peak may be calculated to obtain a common peak spectrum including m/z of the common peaks and the average intensity ($I_{ave}$). Thereafter, when the matrix-removed spectrum to which the complementary peak belongs is the first matrix-removed spectrum, the intensity of the complementary peak may be corrected by multiplying the intensity ratio (Iaveb/I1b) obtained by dividing the intensity (Iaveb) at m/z($m_b$/z) of one common peak in the common peak spectrum by the intensity (I1b) at the same one m/z($m_b$/z) in the first matrix-removed spectrum. Thereafter, the complementary spectrum as the complete mass spectrum of the analyte may be obtained by combining the intensity-corrected complementary peak and the common peak spectrum. Here, in case that the matrix-removed spectrum to which the complementary peak belongs is the second matrix-removed spectrum, the intensity ratio (Iaveb/I2b) obtained by dividing the intensity (Iaveb) at m/z($m_b$/z) of one common peak in the common peak spectrum by the intensity (I2b) at the same one m/z($m_b$/z) in the second matrix-removed spectrum may be multiplied to the intensity ($I_0$) of the complementary peak.

The correction described above is an example of the case where correction is performed in the merging step, but the present invention is not limited thereto. According to the technical concept of the present invention in that, after the signals (peaks) attributable to the matrix are removed from the detection result using two or more organic matrices, information of the analyte lost due to the removal of the matrix signal is complemented using the information present in the other matrix according to the use of the different matrices to thereby obtain the complete information (mass spectrum) of the analyte, any known correction method capable of complementing and canceling out a difference in intensity of each mass spectrum of the same analyte due to the difference between matrices may also be used.

In a specific, non-limiting example, standardizing each of the first detection spectrum and the second detection spectrum, before the removal of the matrix peak of the step b), regardless of whether the above-described correction step is performed, may further be performed.

Specifically, in the standardization step, the intensity of each peak present in each detection spectrum may be divided by a total intensity obtained by accumulating the intensity of each peak present in each detection spectrum to standardize each spectrum, whereby the difference in intensity based on each matrix in each detection spectrum may be canceled out.

That is, the intensity of each peak present in a corresponding detection spectrum is divided by a total intensity obtained by accumulating and adding the intensity of each peak present in each of obtained detection spectrums to standardize each detection spectrum in the step a), peaks attributable to each matrix are removed from each standardized detection spectrum to obtain a standardized matrix-removed spectrum(s) in the step b), and a common peak and a complementary peak are selected from the standardized matrix-removed spectrum and merged in step c), thereby calculating a complete mass spectrum of the analyte.

In the analysis method according to the exemplary embodiment of the present invention described above, the detection spectrum of the step a), the matrix-originating mass spectrum or the m/z corresponding to the matrix peak to be removed used in the step b), and/or each spectrum (or peak) in the common peak or the complementary peak extracted in the step c) may be a spectrum from which noise was removed through normal software known and used in the MALDI mass spectrometry. Alternatively, the analysis method according to an exemplary embodiment of the present invention described above may be performed using only peaks having a predetermined intensity or higher as valid data.

In the analysis method according to an exemplary embodiment of the present invention, the mass spectrometry (detection) may be performed by a time-of-flight (TOF) mass spectrometer (MS), an ion trap (IT) MS, a Fourier transform ion cyclotron resonance (FT-ICR) MS, a quadrupole MS, or an orbitrap MS. Here, the TOF-type mass spectrometer may include a linear TOF or a reflectron TOF.

In the analysis method according to an exemplary embodiment of the present invention, the analyte refers to a target substance for analyzing an ionization mass, and the present invention is more effective in detecting an analyte including a low molecular weight compound having a molecular weight of 1000 daltons or less, and more characteristically, 500 daltons or less. In a specific example, the analyte may include an organic substance, an inorganic substance, a biochemical substance, or a complex thereof. The complex may include a mixture including two or more selected from the organic substance, the inorganic substance, and the biochemical substance and a combination (reactant) formed as two or more selected from the organic substance, the inorganic substance, and the biochemical substance are chemically combined (or reacted). The biochemical substance may include an organic substance or a drug that affects a cell constituent substance, a genetic substance, a carbon compound, a metabolism of an organism, a substance synthesis, a substance transport, or a signal transmission process. The biochemical substance may include a bio sample extracted from a living body and treated, and independently of this, the biochemical substance may include an indicator substance (biomarker) used to detect a disease. Specifically, a biochemical substance may include an organic metal compound, a peptide, a carbohydrate, a protein, a protein complex, a lipid, a metabolome, an antigen, an antibody, an enzyme, a substrate, an amino acid, an aptamer, a sugar, a nucleic acid, a nucleic acid fragment, a peptide nucleic acid (PNA), cell extracts, disease indicators, or combinations thereof (including mixed mixtures or chemically conjugated conjugates), and the like, but is not limited thereto.

In addition, in the present invention, after the signals (peaks) attributable to the matrices are removed from the detection results using two or more organic matrices, information of the analyte lost due to the removal of the matrix signals according to the use of the different matrices is complemented, using information present in another matrix, thus obtaining complete information (mass spectrum) of the analyte. Accordingly, the analyte is not limited to one type of substance and includes a compound having a molecular weight of 1000 daltons or less. An analyte in which two or more types of different substances coexist may also be analyzed, and substantially, a type of an analyte or the number of substances constituting the analyte is not limited.

Exemplary Embodiment 1

As shown in Table 1, three types of biomarkers (indicated by S in Table 1) for inspection of neonatal metabolic abnormalities and nine types (indicated by I in Table 1, NSK-A-Amino Acid Reference Standard, Cambridge Isotope Lab) of isotope-labeled amino acids for a fixed quantity of biomarker were used as analytes. In addition, α-cyano-4-hydroxycinnamic acid (CHCA) was used as a first matrix, 2,5-dihydroxybenzoic acid (DHB) was used as a second matrix, and m/z of ions (matrix ions) generated from each of the first matrix and the second matrix is illustrated in Table 2.

TABLE 1

| Analyte | m/z |
|---|---|
| Leucine (S) | 132 |
| Methionine (S) | 150 |
| Phenylalaine (S) | 166 |
| Valine (I) | 126 |
| Ornithine (I) | 135 |
| Aspartate (I) | 137 |
| Glutamate (I) | 151 |
| Methionine (I) | 153 |
| Phenylalaine (I) | 172 |
| Citrulline (I) | 178 |
| Arginine (I) | 180 |
| Tyrosine (I) | 188 |

TABLE 2

| CHCA matrix (m/z) | DHB matrix (m/z) |
|---|---|
| 146 | 137 |
| 164 | 154 |
| 172 | 155 |
| 190 | 177 |
| 212 | 273 |
| 379 | |

As a matrix solution, a first detection target solution containing 10 mg/ml of CHCA, 300 nmol/ml of leucine (S), and 120 nmol/ml of phenylaiaine (S), 67 nmol/ml of methionine (S), and 300 nmol/ml of nine types (NSK-A-Amino Acid Reference Standard, Cambridge Isotope Lab) of isotope-labeled amino acids was prepared using an acetonitrile/water (1:1 volume ratio) solution containing 0.05 wt % of trifluoroacetic acid (TFA). In addition, a second detection target solution containing 20 mg/ml of DHB, 300 nmol/ml of Leucine (S), 120 nmol/ml of phenylaiaine (S), 67 nmol/ml of methionine (S), and 300 nmol/ml of nine types of isotope-labeled amino acids was prepared using the same acetonitrile/water (1:1 volume ratio) solution containing 0.05 wt % of trifluoroacetic acid (TFA).

Thereafter, 1 μl of each of the first detection target solution and the second detection target solution was dispensed on a stainless steel sample plate and dried to prepare a first sample and a second sample, and then, each sample was analyzed using a MALDI-TOF mass spectrometry (AXIMA LNR MALDI-TOF Mass Spectrometer, Kratos Analytical).

Figure 2:
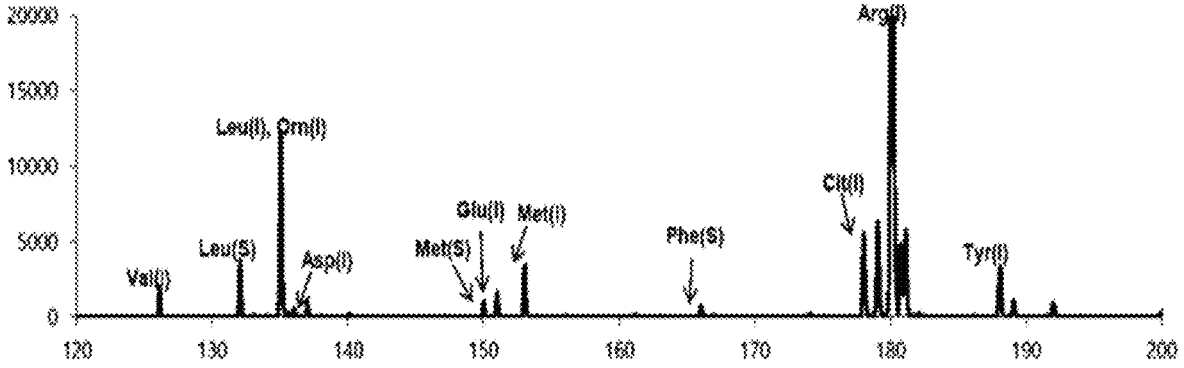
FIG. 2 is a view illustrating a first matrix-removed spectrum obtained in an exemplary embodiment of the present invention.

FIG. 1 is a mass spectrum (first detection spectrum) obtained by performing the MALDI-TOF mass spectrometry on the first sample containing a CHCA matrix. FIG. 2 is a view illustrating a first matrix-removed spectrum as a mass spectrum from which the peak of a mass corresponding to the CHCA matrix was removed from the first detection spectrum. In FIGS. 1 and 2, the peaks indicated in blue are peaks of the isotope-labeled amino acid, the peaks indicated in red are peaks of the biomarker, and the peaks indicated in black in FIG. 1 are peaks due to the matrix (CHCA).

Figure 3:
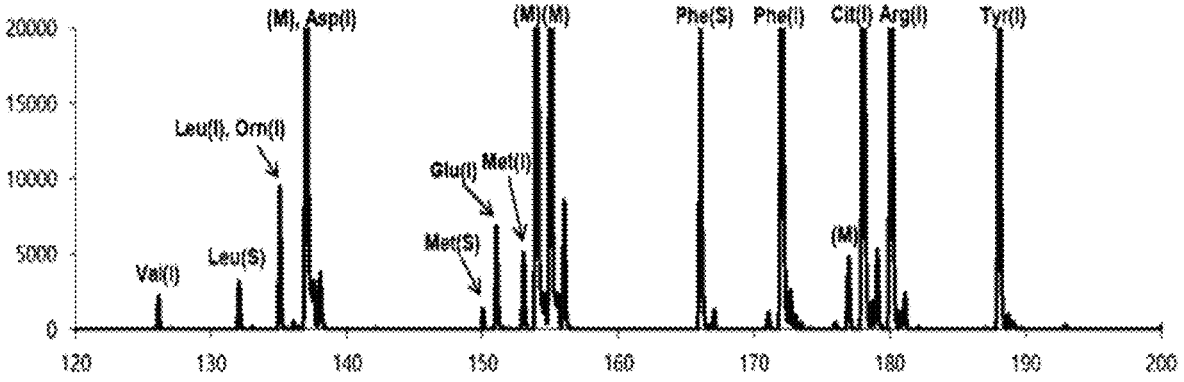
FIG. 3 is a view illustrating a second detection spectrum measured in an exemplary embodiment of the present invention.
Figure 4:
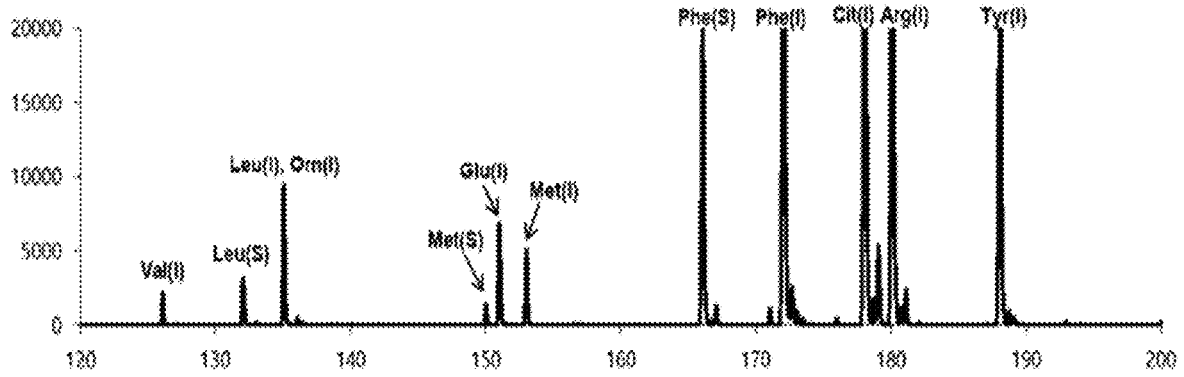
FIG. 4 is a view illustrating a second matrix-removed spectrum obtained in an exemplary embodiment of the present invention.

FIG. 3 is a mass spectrum (second detection spectrum) obtained by performing a MALDI-TOF mass spectrometry on the second sample containing a DHB matrix. FIG. 4 is a view illustrating a second matrix-removed spectrum from which is a peak of a mass corresponding to the DHB matrix was removed from the second detection spectrum. Similar to FIGS. 1 and 2, in FIGS. 3 and 4, the peaks indicated in blue are peaks of the isotope-labeled amino acid, the peaks indicated in red are peaks of the biomarker, and the peaks indicated in black in FIG. 3 are peaks due to the matrix (DHB).

Figure 5:
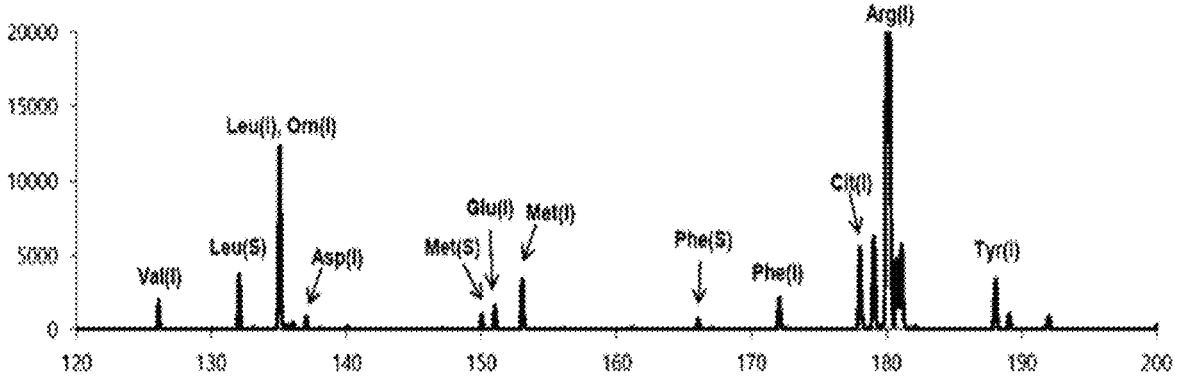
FIG. 5 is a view illustrating a correction spectrum which is a complete mass spectrum of the analyte obtained in an exemplary embodiment of the present invention.

FIG. 5 is a graph illustrating a corrected spectrum calculated by merging the first matrix-removed spectrum of FIG. 2 and the second matrix-removed spectrum of FIG. 4, combining the complementary peak (Phe (I) of FIG. 4) present only in the second matrix-removed spectrum with the first matrix-removed spectrum, correcting (original intensity of complementary peak×Phe (S) intensity of first matrix-removed spectrum/Phe (S) intensity of second matrix-removed spectrum) the intensity of the complementary peak using the intensity ratio of the complementary peak and the most adjacent common peak Phe (S), and adding them. As can be seen from FIG. 5, all three kinds of biomarkers and nine kinds of amino acids are detected and the complete mass spectrum of the substance to be detected is calculated.

Hereinabove, although the present invention is described by specific matters, limited exemplary embodiments, and drawings, they are provided only for assisting in the entire understanding of the present invention. Therefore, the present invention is not limited to the exemplary embodiments. Various modifications and changes may be made by those skilled in the art to which the present invention pertains from this description.

Therefore, the spirit of the present invention should not be limited to the above-described exemplary embodiments, and the following claims as well as all modified equally or equivalently to the claims are intended to fall within the scope and spirit of the invention.

The invention claimed is:

1. A matrix-assisted laser desorption ionization (MALDI) mass spectrometry method comprising:

performing matrix-assisted laser desorption ionization on an analyte to obtain a mass spectrum, wherein a detection spectrum which is a mass spectrum of the analyte is obtained using each of two or more different matrices used for a same mass range, wherein each of two or more detection spectrums consists of peaks from the same mass ranges; and removing a peak of a corresponding matrix from each detection spectrum to obtain a matrix-removed spectrum and subsequently obtaining a corrected mass spectrum of the analyte on a basis of the matrix-removed spectrum of each of the different matrices, wherein the corrected mass spectrum is calculated by merging peaks commonly present in the two or more matrix-removed spectrums and a peak present only in one matrix-removed spectrum.

2. The MALDI mass spectrometry method of claim 1, comprising step a) of irradiating a first sample including the analyte and a first matrix with a laser to obtain a first detection spectrum and irradiating a second sample including the analyte and a second matrix with the laser to obtain a second detection spectrum;

step b) of removing a peak of the first matrix from the first detection spectrum to obtain a first matrix-removed spectrum and removing a peak of the second matrix from the second detection spectrum to obtain a second matrix-removed spectrum; and step c) of obtaining the corrected mass spectrum of the analyte on the basis of the first matrix-removed spectrum and the second matrix-removed spectrum.

3. The MALDI mass spectrometry method of claim 2, wherein step c) includes: merging a common peak as a peak commonly present in the first matrix-removed spectrum and the second matrix-removed spectrum and a complementary peak as a peak present only in one of the first matrix-removed spectrum and the second matrix-removed spectrum.

4. The MALDI mass spectrometry method of claim 3, further comprising:

correcting an intensity of the complementary peak using an intensity ratio between the common peak of the first matrix-removed spectrum and the common peak of the second matrix-removed spectrum, in the merging.

5. The MALDI mass spectrometry method of claim 3, further comprising:

calculating an average intensity for each m/z of the common peak to obtain a common peak spectrum, in the merging; and multiplying a ratio, which is obtained by dividing an intensity of one peak on the common peak spectrum by an intensity in the same m/z as the one peak on the matrix-removed spectrum to which the merged complementary peak belongs, by an intensity of the complementary peak to correct the intensity of the complementary peak.

6. The MALDI mass spectrometry method of claim 2, wherein step b) further includes: standardizing each of the first detection spectrum and the second detection spectrum, before removal of the matrix peak, wherein the standardization step is performed by dividing an intensity of each peak present in each detection spectrum by a total intensity obtained by accumulating the intensity of each peak present in each detection spectrum.

7. The MALDI mass spectrometry method of claim 2, further comprising:

irradiating the laser to each of a first reference sample not containing the analyte and containing the first matrix and a second reference sample not containing the analyte and containing the second matrix to obtain a mass spectrum originating from each matrix, before step a).

8. The MALDI mass spectrometry method of claim 2, wherein a smallest m/z difference in mass (m/z) among mass (m/z) differences between peaks belonging to matrices different from each other in the peaks of the first matrix and the peaks of the second matrix is 1 or greater.

9. The MALDI mass spectrometry method of claim 1, wherein the different matrices are two or more substances selected from among α-cyano-4-hydroxycinnamic acid (CHCA), 2,5-dihydroxybenzoic acid (DHB), 2-(4-hydroxyphenylazo)-benzoic acid (HABA), 2-mercaptobenzo-thiazole (MBT), and 3-Hydroxypicolinic acid (3-HPA).

10. The MALDI mass spectrometry method of claim 1, wherein the analyte includes a compound of 1000 daltons or less.

11. The MALDI mass spectrometry method of claim 1, wherein the MALDI mass spectrometry uses a time-of-flight (TOF) mass spectrometer (MS), an ion trap (IT) MS, a Fourier transform ion cyclotron resonance (FT-ICR) MS, a quadrupole MS, or an orbitrap MS.

* * * * *